US008092318B2

(12) United States Patent
Oldknow et al.

(10) Patent No.: US 8,092,318 B2
(45) Date of Patent: Jan. 10, 2012

(54) GOLF CLUB ASSEMBLY AND GOLF CLUB WITH SUSPENDED FACE PLATE

(75) Inventors: Andrew G. V. Oldknow, Portland, OR (US); Donald S. Rahrig, Mansfield, TX (US)

(73) Assignee: NIKE, Inc., Beaverton, OR (US)

( * ) Notice: Subject to any disclaimer, the term of this patent is extended or adjusted under 35 U.S.C. 154(b) by 11 days.

(21) Appl. No.: 12/577,433

(22) Filed: Oct. 12, 2009

(65) Prior Publication Data

US 2011/0086722 A1 Apr. 14, 2011

(51) Int. Cl.
*A63B 53/04* (2006.01)

(52) U.S. Cl. ..... 473/329; 473/332; 473/342; 473/350

(58) Field of Classification Search ..... 473/324–350, 473/287–292
See application file for complete search history.

(56) References Cited

U.S. PATENT DOCUMENTS

| | | | | | |
|---|---|---|---|---|---|
| 700,946 | A | * | 5/1902 | Kempshall | 473/329 |
| 708,575 | A | * | 9/1902 | Mules | 473/329 |
| 819,900 | A | * | 5/1906 | Martin | 473/329 |
| 1,463,533 | A | | 7/1923 | Kurz, Jr. | |
| 3,390,881 | A | * | 7/1968 | Senne | 473/342 |
| 3,975,023 | A | * | 8/1976 | Inamori | 473/329 |
| 4,884,808 | A | * | 12/1989 | Retzer | 473/288 |
| 4,984,800 | A | * | 1/1991 | Hamada | 473/346 |
| 5,154,424 | A | * | 10/1992 | Lo | 473/338 |
| 5,398,929 | A | * | 3/1995 | Kitaichi | 473/329 |
| 5,405,137 | A | * | 4/1995 | Vincent et al. | 473/342 |
| 5,509,660 | A | * | 4/1996 | Elmer | 473/288 |
| 6,001,030 | A | | 12/1999 | Delaney | |
| 6,364,789 | B1 | * | 4/2002 | Kosmatka | 473/329 |
| 6,431,997 | B1 | | 8/2002 | Rohrer | |
| 6,672,975 | B1 | * | 1/2004 | Galloway | 473/342 |
| 7,413,517 | B2 | * | 8/2008 | Butler et al. | 473/288 |
| 7,416,494 | B2 | * | 8/2008 | Edel | 473/288 |
| 7,604,550 | B1 | * | 10/2009 | Currie | 473/342 |
| 2008/0004131 | A1 | * | 1/2008 | Lin et al. | 473/342 |
| 2011/0034270 | A1 | * | 2/2011 | Wahl et al. | 473/342 |

FOREIGN PATENT DOCUMENTS

| | | | |
|---|---|---|---|
| JP | 7255884 | A | 10/1995 |
| JP | 2004242952 | A | 9/2004 |
| WO | 0038796 | A1 | 7/2000 |

OTHER PUBLICATIONS

International Search Report and Written Opinion issued Feb. 21, 2011 in corresponding PCT Application No. PCT/US2010/052159.

* cited by examiner

*Primary Examiner* — Sebastiano Passaniti
(74) *Attorney, Agent, or Firm* — Banner & Witcoff, Ltd.

(57) ABSTRACT

A golf club head includes a body member having a front surface, a major recess formed in the front surface, and a plurality of minor recess formed in a surface of the major recess. A face plate includes a front surface, a rear surface, and a plurality of projections extending outwardly from the rear surface. The face plate is received in the major recess, and each projection is received in a corresponding minor recess. A layer of resilient material may be disposed between each projection and the corresponding minor recess.

19 Claims, 3 Drawing Sheets

GOLF CLUB ASSEMBLY AND GOLF CLUB WITH SUSPENDED FACE PLATE

FIELD

Aspects of this invention relate generally to golf clubs and golf club heads, and, in particular, to a golf club and golf club head with a face plate suspended on the club head.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it is swung and strikes a ball. "Feel" also has been found to be related to the vibrations produced when a club head face strikes a ball to send the ball in motion. These vibrations are transmitted from the club head through the shaft to the user's hands. If the user senses undesirable vibrations, the user may flinch, give up on his/her swing, decelerate the swing, lose his/her grip, and/or not completely follow-through on the swing, thereby affecting distance, direction, and/or other performance aspects of the swing and the resulting ball motion. User anticipation of these undesirable vibrations can affect a swing even before the ball is hit.

Isolating or optimizing the vibration created at the face of the club head from the shaft would result in an improved "feel" for the user. It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club with a face plate suspended on the head of the golf club. In accordance with a first aspect, a golf club head includes a body member having a front surface, a major recess formed in the front surface, and a plurality of minor recess formed in a surface of the major recess. A face plate includes a front surface, a rear surface, and a plurality of projections extending outwardly from the rear surface. The face plate is received in the major recess, and each projection is received in a corresponding minor recess. A layer of resilient material may be disposed between each projection and the corresponding minor recess.

In accordance with another aspect, a golf club head includes a body member having a front surface, a major recess formed in the front surface, and a plurality of minor recess formed in a surface of the major recess. A face plate has a front surface, a rear surface, a peripheral edge, and a plurality of projections extending outwardly from the rear surface. The face plate is received in the major recess, with each projection being received in a corresponding minor recess, and a tip of each projection being in direct contact with the body member. The rear surface and peripheral edge of the face plate are spaced from the body member. A first layer of resilient material is disposed between each projection and the corresponding minor recess, and a second layer of resilient material is disposed between the peripheral edge of the face plate and the body member.

In accordance with a further aspect, a golf club assembly includes a shaft, and a club head secured to a first end of the shaft. The club head includes a body member having a front surface, a major recess formed in the front surface, and a plurality of minor recess formed in a surface of the major recess. A face plate has a front surface, a rear surface, and a plurality of projections extending outwardly from the rear surface. The face plate is received in the major recess, and each projection is received in a corresponding minor recess. A layer of resilient material is disposed between each projection and the corresponding minor recess.

By providing a face plate suspended on the club head of a golf club according to certain embodiments. The amount of vibration sensed by the hands of a user when a golf ball is struck with the golf club can be reduced. As such the "feel" of the club for the user may be improved making the user more comfortable with their swing.

These and additional features and advantages disclosed here will be further understood from the following detailed disclosure of certain embodiments.

Figure 1:
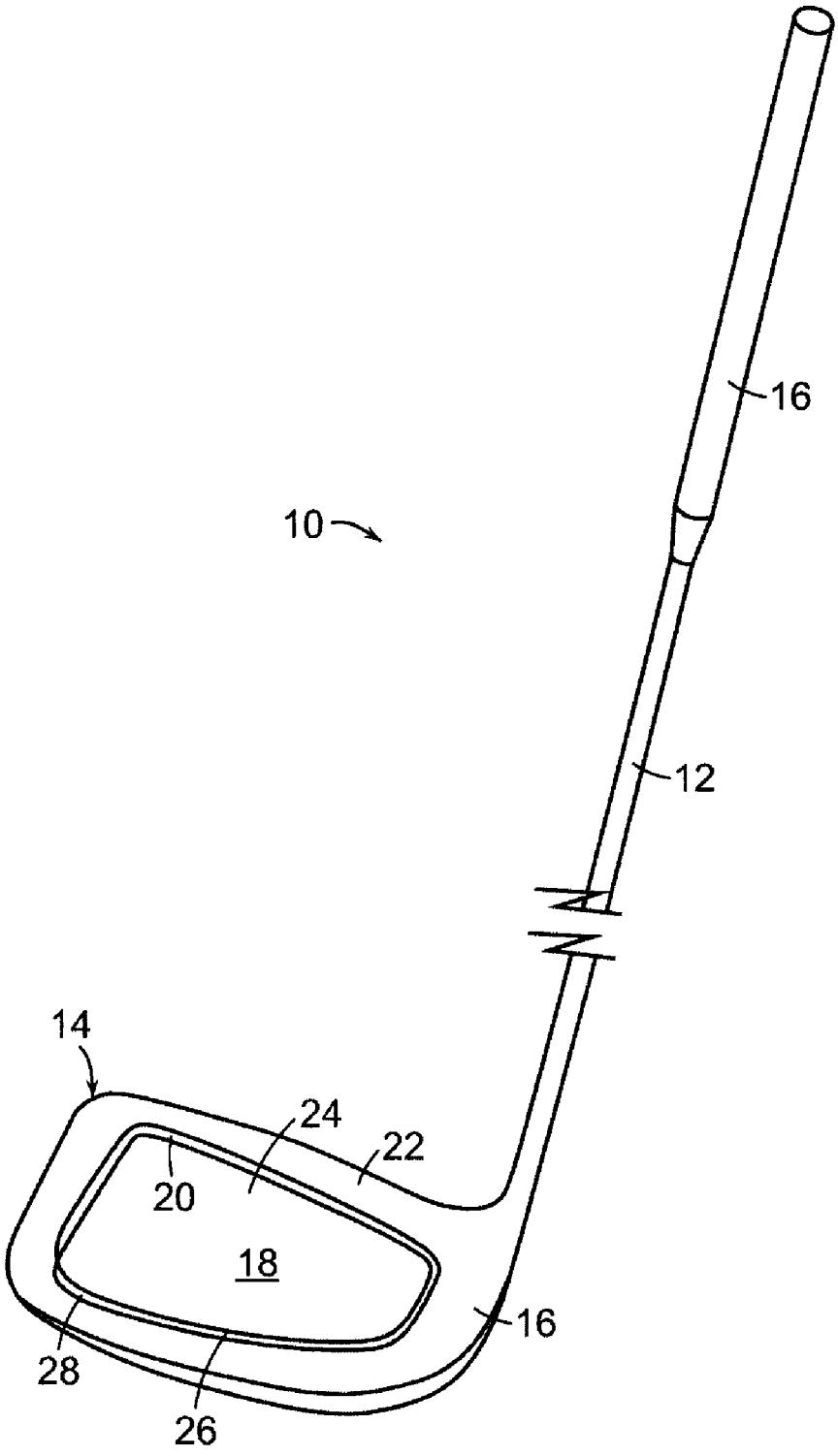
FIG. 1 is a perspective view of a golf club with a suspended club head face plate according to an illustrative aspect.

The figures referred to above are not drawn necessarily to scale, should be understood to provide a representation of particular embodiments of the invention, and are merely conceptual in nature and illustrative of the principles involved. Some features of the golf club with a suspended face plate depicted in the drawings have been enlarged or distorted relative to others to facilitate explanation and understanding. The same reference numbers are used in the drawings for similar or identical components and features shown in various alternative embodiments. Golf clubs with a suspended face plate as disclosed herein would have configurations and components determined, in part, by the intended application and environment in which they are used.

DETAILED DESCRIPTION

An illustrative embodiment of a golf club 10 is shown in FIG. 1 and includes a shaft 12 and a golf club head 14 attached to the shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 includes a plurality of components. As illustrated, this example golf club head 14 includes a body member 16 with a face plate 18. Face plate 18 is received in a major recess 20 formed in a front surface 22 of body member 16. In certain embodiments, a front surface 24 of face plate 18 is flush with front surface 22 of body member 16. A peripheral edge 26 of face plate 18 is spaced from major recess 20 of body member 16, forming a gap 28 therebetween.

In certain embodiments, face plate 18 and body member 16 are formed of the same material. It is to be appreciated, however, that face plate 18 and body member could be formed of dissimilar materials as well. Suitable materials for each of face plate 18 and body member 16 will become readily apparent to those skilled in the art, given the benefit of this disclosure.

Figure 2:
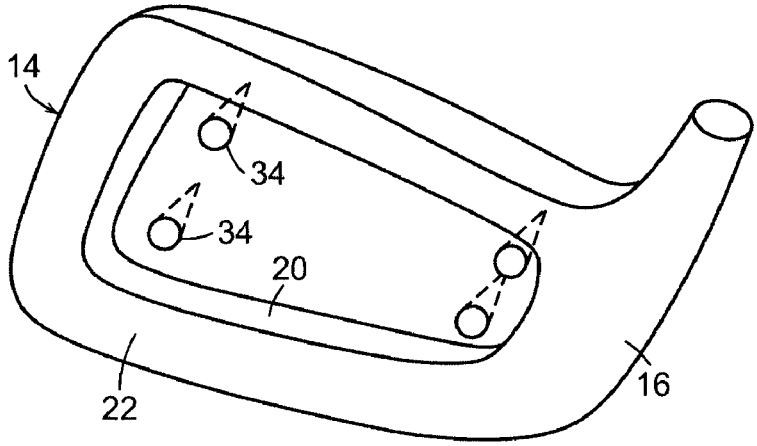
FIG. 2 is a perspective view of the club head of the golf club of FIG. 1, shown with the face plate removed.
Figure 3:
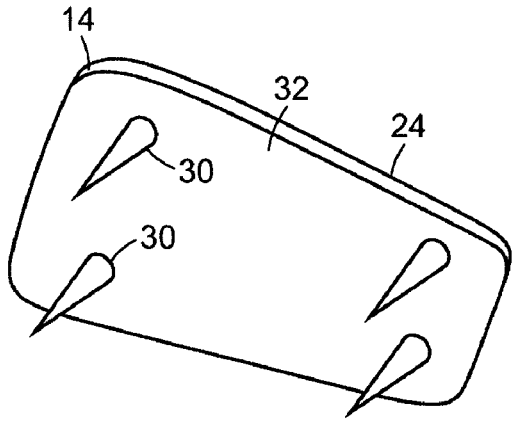
FIG. 3 is a rear perspective view of the face plate of the golf club of FIG. 1.
Figure 4:
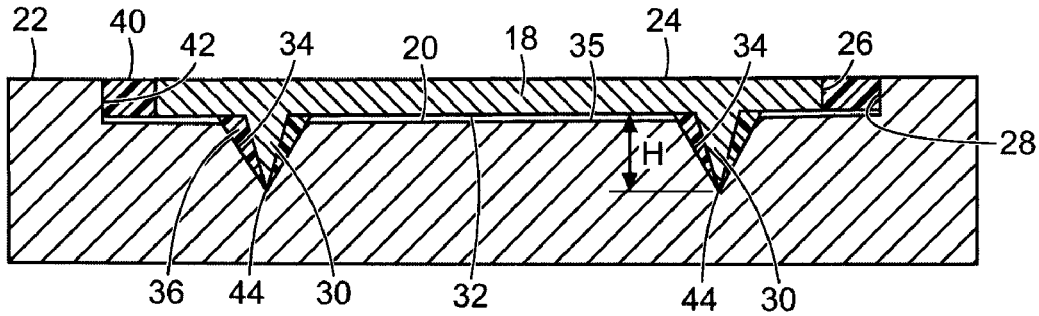
FIG. 4 is a section view of the club head and face plate of the golf club of FIG. 1.

As seen in FIGS. 2-4, a plurality of projections 30 extend outwardly from a rear surface 32 of face plate 18. Each projection 30 is received in a corresponding minor recess 34 formed in a front facing surface 35 of major recess 20. In the illustrated embodiment, projections 30 are unitary, that is, of one-piece construction with face plate 18. It is to be appreciated that projections 20 may be separate elements secured to rear surface 32 of face plate 18 by welding, with adhesive, or by any other suitable fastening means.

In certain embodiments, projections 30 have a height H of between approximately 0.5 mm and approximately 7 mm, more preferably between approximately 1 mm and approximately 5 mm, and most preferably approximately 4 mm.

A first layer 36 of resilient material 38 is disposed in each minor recess 34 between a corresponding projection 30 and the minor recess 34, as seen in FIG. 4. A second layer 40 of resilient material 38 is disposed about peripheral edge 26 of face plate 14 between a sidewall 42 of major recess 20 and peripheral edge 26 of face plate 14.

Resilient material 38 is a resilient, pliable, and flexible material that serves to isolate elements of club head 14 from one another, thereby reducing the vibration transmitted from one element to another. In certain embodiments, resilient material 38 is urethane. Other suitable materials for resilient material 38 include elastomers, rubbers, composites, and viscoelastic polymers. Other suitable materials for resilient material 38 will become readily apparent to those skilled in the art, given the benefit of this disclosure.

The use of projections 30, corresponding minor recesses 34, and resilient material 38 serves to provide a way to suspend face plate 14 above body member 16, and isolate the vibrations created by the impact of a golf ball with face plate 14 from the remainder of golf club 10, and in particular shaft 12 so that the vibrations felt by the user are reduced.

In certain preferred embodiments, as illustrated in FIG. 4, a tip 44 of each projection 30 is in direct contact with body member 16, and rear surface 32 of face plate 14 is spaced from front facing surface 35 of major recess 20.

In this embodiment, there are four projections 30 and corresponding minor recesses 34 in which projections 30 are received. It is to be appreciated that any number of projections 30 and corresponding minor recesses 34 can be formed on face plate 14 and body member 16, respectively.

Figure 5:
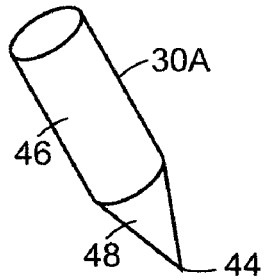
FIG. 5 is a perspective view of an alternative embodiment of a projection of the face plate of the golf club of FIG. 1.

Another embodiment of a projection 30A is illustrated in FIG. 5, in which projection 30A is formed of a cylindrical base portion 46 and a conical top portion 48, which terminates in tip 44.

Figure 6:
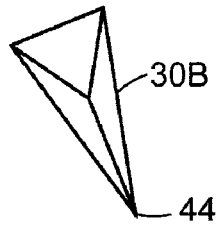
FIG. 6 is a perspective view of another alternative embodiment of a projection of the face plate of the golf club of FIG. 1.

Yet another alternative embodiment of a projection 30B is illustrated in FIG. 6, in which projection 30B is a triangular pyramid, which terminates in tip 44.

Figure 7:
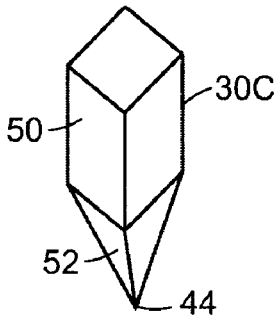
FIG. 7 is a perspective view of yet another alternative embodiment of a projection of the face plate of the golf club of FIG. 1.

A further embodiment of a projection 30C is illustrated in FIG. 7, in which projection 30C is formed of a base portion 50 having a rectangular cross-section and a top portion 52, which terminates in tip 44.

Figure 8:
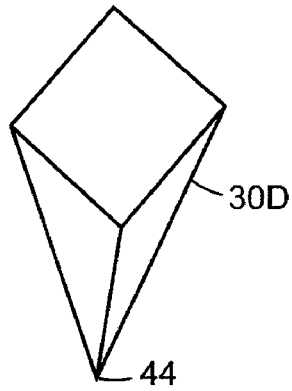
FIG. 8 is a perspective view of a further alternative embodiment of a projection of the face plate of the golf club of FIG. 1.

Yet another embodiment of a projection 30D is illustrated in FIG. 8, in which projection 30D is a quadrilateral pyramid, which terminates in tip 44. For each embodiment with any of projections 30A-D, minor recesses 34 have a shape corresponding to the shape of the projection to be received therein.

Figure 9:
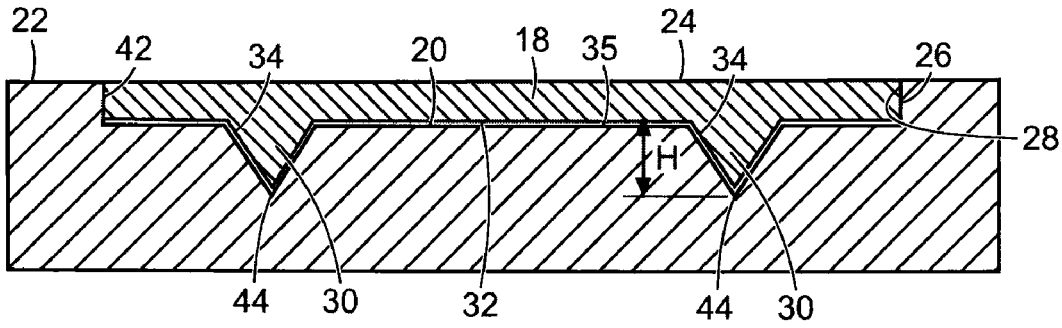
FIG. 9 is a section view of an alternative embodiment of a club head and face plate of a golf club.

Another embodiment is illustrated in FIG. 9, in which face plate 18 is received in major recess 20 without any resilient material between face plate 18 and body member 16. In the illustrated embodiment, rear surface 32 of face plate 14 is spaced from front facing surface 35 of major recess 20. It is to be appreciated that rear surface 32 may be in direct contact with front facing surface 35 in certain embodiments. Tip 44 is illustrated as being in contact with body member 16 within minor recess 34. It is to be appreciated that the entire surface of projection 30 may be in contact with minor recess 34 in certain embodiments.

By varying the geometry of projections 30, minor recesses 34, as well as the points of engagement of face plate 14 with body member 16, and incorporating resilient material within club head 10 in certain embodiments but not in others, the vibrations distributed throughout club head 10 may be varied, and, ultimately, fine-tuned or optimized for a particular player or players.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body member having a front surface, a major recess formed in the front surface, and a plurality of minor recesses formed in a surface of the major recess; and a face plate having a front surface, a rear surface, a peripheral edge, and a plurality of projections extending outwardly from the rear surface, the peripheral edge of the face plate being spaced from the body member and defining a gap about the entire peripheral edge between the face plate and the body member, the face plate being received in the major recess, and each projection being received in a corresponding minor recess, the rear surface being spaced from a front surface of the major recess to form a spacing therebetween, the spacing being free of material other than the projections.

2. The golf club head of claim 1, wherein a tip of each projection is in direct contact with the body member.

3. The golf club head of claim 1, wherein the projections and minor recesses are cone shaped.

4. The golf club head of claim 1, wherein the front surface of the face plate is flush with the front surface of the body member.

5. The golf club head of claim 1, further comprising a layer of resilient material disposed between each projection and the corresponding minor recess.

6. The golf club head of claim 5, further comprising an additional layer of resilient material positioned between a peripheral edge of the face plate and the major recess.

7. The golf club head of claim 5, wherein the resilient material is urethane.

8. The golf club head of claim 5, wherein the resilient material is an elastomer.

9. A golf club head comprising:

a body member having a front surface, a major recess formed in the front surface, and a plurality of recesses formed in a surface of the major recess;

a face plate having a front surface, a rear surface, a peripheral edge, and a plurality of projections extending outwardly from the rear surface, the face plate being received in the major recess, each projection being received in a corresponding minor recess with a tip of each projection being in direct contact with the body member, and the rear surface and peripheral edge of the face plate being spaced from the body member, the rear surface being spaced from a front surface of the major recess to form a spacing therebetween, the spacing being free of material other than the projections; and a first layer of resilient material disposed between each projection and the corresponding minor recess, and a second layer of resilient material being disposed between the peripheral edge of the face plate and the body member.

10. The golf club head of claim 9, wherein the resilient material is urethane.

11. The golf club head of claim 9, wherein the resilient material is an elastomer.

12. The golf club head of claim 9, wherein the projections and minor recesses are cone shaped.

13. A golf club assembly comprising:

a shaft; and a club head secured to a first end of the shaft and comprising:

a body member having a front surface, a major recess formed in the front surface, and a plurality of minor recesses formed in a surface of the major recess;

a face plate having a front surface, a rear surface, a peripheral edge, and a plurality of projections extending outwardly from the rear surface, the peripheral edge of the face plate being spaced from the body member and defining a gap about the entire peripheral edge between the face plate and the body member, the face plate being received in the major recess, and each projection being received in a corresponding minor recess, the rear surface being spaced from a front surface of the major recess to form a spacing therebetween, the spacing being free of material other than the projections; and a layer of resilient material disposed between each projection and the corresponding minor recess.

14. The golf club assembly of claim 13, wherein a tip of each projection is in direct contact with the body member.

15. The golf club assembly of claim 13, wherein the projections and minor recesses are cone shaped.

16. The golf club assembly of claim 13, wherein the front surface of the face plate is flush with the front surface of the body member.

17. The golf club assembly of claim 13, further comprising an additional layer of resilient material positioned between a peripheral edge of the face plate and the major recess.

18. The golf club assembly of claim 13, wherein the resilient material is urethane.

19. The golf club head of claim 13, wherein the resilient material is an elastomer.

* * * * *